United States Patent [19]

Böttigheimer et al.

[11] Patent Number: 4,514,835

[45] Date of Patent: Apr. 30, 1985

[54] DEVICE FOR MEASURING TIME INTERVALS BETWEEN A PLURALITY OF SUCCESSIVE EVENTS

[75] Inventors: Andreas Böttigheimer, Neuffen; Karl-Heinz Einsele, Weilheim; Klaus Henig, Tubingen, all of Fed. Rep. of Germany

[73] Assignee: Robert Bosch GmbH, Stuttgart, Fed. Rep. of Germany

[21] Appl. No.: 615,472

[22] Filed: May 29, 1984

[30] Foreign Application Priority Data

Aug. 6, 1983 [DE] Fed. Rep. of Germany ..... 3328540

[51] Int. Cl.[3] ..... G04F 8/00; G04F 10/00

[52] U.S. Cl. ..... 368/118

[58] Field of Search ..... 368/113, 117–120; 324/78 R, 78 D; 377/5, 20

[56] References Cited

U.S. PATENT DOCUMENTS

| | | | |
|---|---|---|---|
| 3,842,347 | 10/1974 | Terbrauz | 368/118 |
| 4,079,315 | 3/1978 | Mohr | 368/118 |
| 4,107,600 | 3/1978 | McMannis | 324/78 R |
| 4,160,154 | 7/1979 | Jennings | 368/118 |

*Primary Examiner*—Vit W. Miska

*Attorney, Agent, or Firm*—Michael J. Striker

[57] ABSTRACT

A device for measuring time intervals between a plurality of successive events includes a clock pulse generator coupled via a gating circuit to a counter. The output of the counter is connected to a shift register for screening out and storing momentary counts of the counter. A first logic control circuit is actuated by a first event signal and preferably is controlled by a computer to set in response to the first event signal the start of a gating time determining the measuring cycle. The length of the gating time is controlled preferably by a computer. A second logic control circuit receives the successive events and generates readout command signals after which the shift register reads out and stores the momentary count in the counter.

6 Claims, 23 Drawing Figures

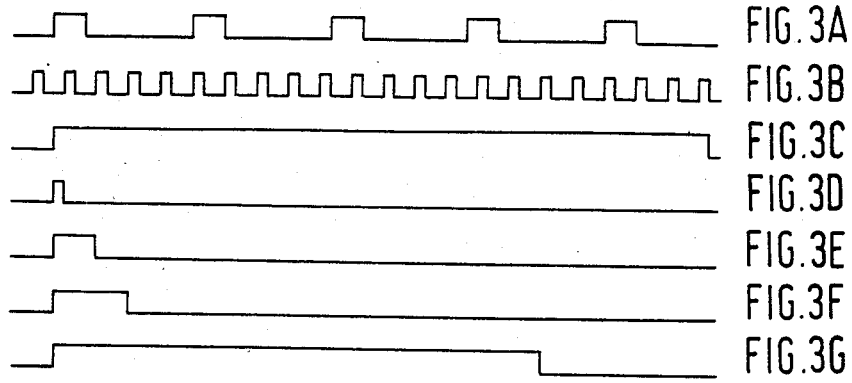
FIG.3A
FIG.3B
FIG.3C
FIG.3D
FIG.3E
FIG.3F
FIG.3G
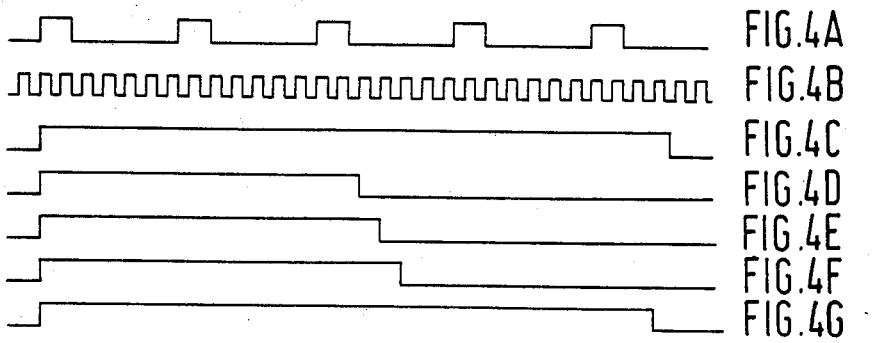
FIG.4A
FIG.4B
FIG.4C
FIG.4D
FIG.4E
FIG.4F
FIG.4G
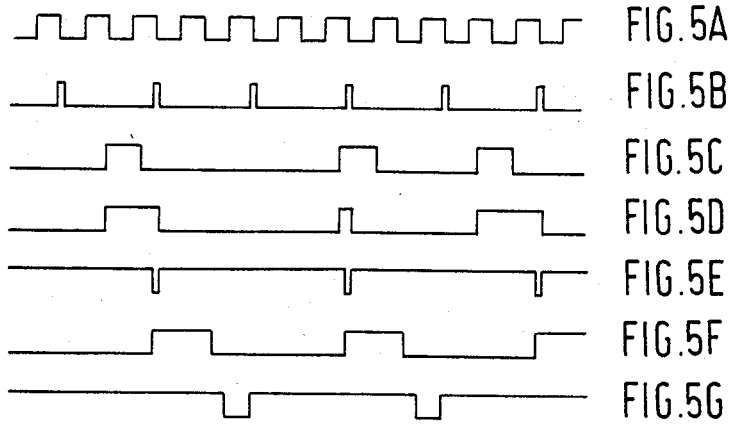
FIG.5A
FIG.5B
FIG.5C
FIG.5D
FIG.5E
FIG.5F
FIG.5G

DEVICE FOR MEASURING TIME INTERVALS BETWEEN A PLURALITY OF SUCCESSIVE EVENTS

BACKGROUND OF THE INVENTION

The present invention relates in general to time measurements and in particular to a device for measuring time interval between a first or starting event and a plurality of successive events, using a gating circuit, a clock generator, and a counter for counting the clock pulses between respective events.

Devices for measuring time periods are generally known. Conventional counting devices of the beforedescribed type are capable of measuring the time between a start and a stop signal. By means of a start signal a train of clock pulses is generated at a relatively high frequency by the clock generator. The stop signal terminates the generation of the clock pulses. The number of clock pulses generated in the meantime is counted in a counter and indicated. In this manner an accurate measurement of the time interval between two events is realized and the accuracy of the measurement is determined only by the accuracy of the clock generator and by the frequency employed. Such known time measuring devices have the disadvantage that they are unuseable for measuring time intervals in a sequence of pulses that means when a plurality of successive events is present. If by means of such prior art devices time intervals between a plurality of consecutive events is to be measured than several counting circuits would be necessary so that each counting circuit be employed for measuring a time interval between two assigned events in the succession of such events. This kind of measurement could be made in a simple manner only in the case when the two pulses or events are available separately so that each counter could be supplied with a corresponding separate pair of event signals. An evaluation of time intervals in a sequence of pulses such as frequently occur in digital technology is not possible with the prior art devices. For this purpose, the so-called logic analyzers are used. The logic analyzers however have a complicated construction and are expensive. Analog signals and asynchronous signals cannot be measured with the logic analyzers.

SUMMARY OF THE INVENTION

It is therefore a general object of the present invention to overcome the aforementioned disadvantages.

More particularly, it is an object of the invention to provide a measuring device of the beforedescribed kind in which after a first or start event signal the time intervals between the start signal and the subsequent events are stored in such a manner that each time interval is retreivable for further processing.

Another object of the invention is to provide such an improved time measuring device which not only determines time intervals but also relationships between successive time intervals.

A further object of this invention is to provide a time measuring device which is simple to manufacture and relatively low in cost by using a single counter only for all time intervals to be measured and by using a shift register as a storing member.

Furthermore, an objective of this invention is to enable further processing of the time data stored in the storing device by means of data processing devices.

In keeping with these objects and others which will become apparent hereinafter, one feature of the invention resides, in a time measuring device of the aforedescribed kind, in the provision of a multistage storing device connected to the input of the counter and to a logic control circuit in such a manner that after the receipt of a readout command from the control circuit a momentary count at the instant corresponding to the occurrence of the consecutive events, is stored in corresponding stages of the memory device whereby the readouts are made during a predetermined gating time defining one measuring cycle.

Preferably the storing device is in the form of a shift register in which upon shifting the oldest measured data into the last storing stage the newest data replace the oldest one. In this way it is insured that in the storing shift register having a limited storing capacity the newest measured data are always stored. This feature is of advantage when the end of data words is to be tested.

According to another feature of this invention, means are provided which synchronize signals of the subsequent events with the clock signal. By this measure it is achieved that the counter is stopped and counting result is entered into the storing device only then when the counted data do not change and consequently a reliable readout of the counted data is guaranteed. The synchronizing means enable in very simple manner to fulfill this requirement. It is also of advantage when the gating time defining a measuring cycle is determined by means of a programmable frequency divider. The adjustability of the gating time according to a program makes the adjustment of the measuring cycle to different measuring conditions particularly simple. Preferably, the entire measuring device is controlled by a computing device by means of which not only the gating time but also the first of starting event is generated. At the same time the computing device evaluates according to a program the measured data stored in the shift register and advances the results for further processing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIGS. 3A through 3G and 4A through 4G illustrate respectively the operation of the device of this invention;

FIGS. 5A through 5G illustrate in time plots the operation of the control logic circuit.

DESCRIPTION OF THE PREFERRED EMBODIMENTS

The time measuring device according to this invention offers the possibility to measure and store a succession of time intervals each beginning at start signal defined by a first event and ending by a stop signal determined by the successive events. The measuring cycle itself takes place during a gating time whose duration is programmable. The time measuring device according to this invention is suitable particularly for measuring pulse sequences of serial data such as contact bouncing times of relays and switches or pulse frequency and pulse width of pulse modulated signals.

Figure 1:
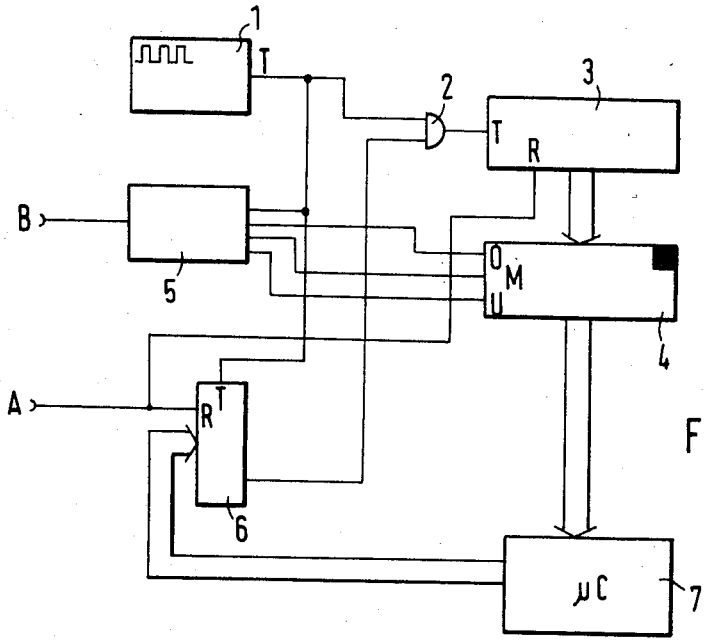
FIG. 1 is a block circuit diagram of the measuring device according to this invention.

Referring to FIG. 1 there is illustrated a clock pulse generator 1 which is constructed for example as a quartz oscillator generating at a clock frequency of about 10 megahertz. The output signal T from the clock pulse generator 1 is applied to an input of an AND gate 2 an also to a clock input of a control logic circuit 5 which will be described in greater detail below, and to a programmable frequency divider 6. The output of the programmable divider 6 is connected to an input of a further AND gate 2. The output of the AND gate 2 is connected to a clock input of a counter 3. The outputs of the counter 3 are connected via a data bus to a storing unit 4 which preferably is in the form of a shift register.

The control logic circuit 5 has a clock input T connected with the output of the clock pulse generator 1 and as stop signal input B through which signals corresponding to the measured successive events are applied. In response to each stop pulse at the input B the actual count of clock pulses in the counter 3 is entered in the shift register 4. The shift register 4 is controlled by the output from the control logic circuit 5. The input M of the shift register 4 receives from the circuit 5 a readout command signal which causes the entry of the data contents in the counter 3 into a storing stage of the shift register. When the last storing stage is reached, an overflow signal is transmitted from the output O to a corresponding input in the control logic circuit 5. Another output of the control logic circuit 5 is connected to an unclock input U of the shift register Due to the transmission of an unclock signal the shift register 4 clears the oldest storing location so that the first information can be overridden by the new one.

The clock signal T from the clock pulse generator 1 is also applied to a clock input of a programmable frequency divider 6. The frequency divider also includes a resetting input R through which a first event or start signal A is applied. The input signal A represents a first event to which all successive events are related. The dividing ratio of the programmable divider is determined by a microprocessor or computer 7 connected to the frequency divider 6 via a data bus. The start signal corresponding to the first event A is also applied to the resetting input R of the counter 3. The output of the shift register 4 is connected via a data bus to the input of the microprocessor 7.

Figure 2:
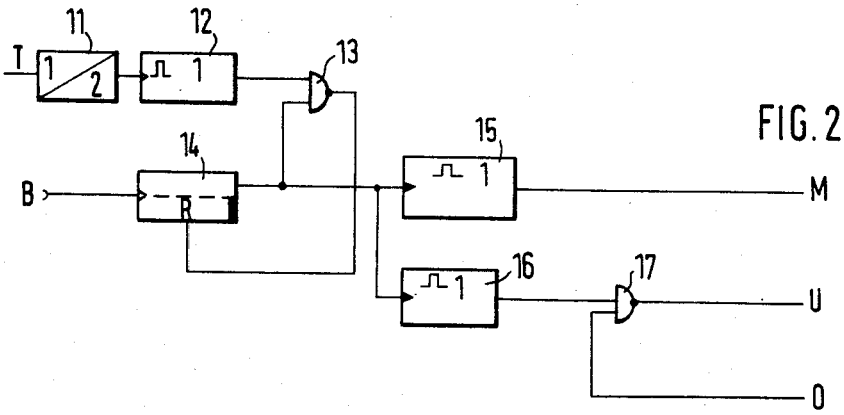
FIG. 2 is an embodiment of the control logic circuit in the device of FIG. 1.

An example of the control logic circuit 5 of FIG. 1 is illustrated in greater detail in the block circuit diagram of FIG. 2. The clock signal P is fed to a frequency divider 11 which divides the clock signal by two. A monostable multivibrator 12 has its setting input connected to the output of the divider 11 and the output of the monostable multivibrator 12 is connected to one input of a NAND gate 13 whose output is connected to a reset input of a flip-flop 14. Signals B of the measured successive events is applied to a set input of the flip-flop 14 and causes the latter to change its state. The output of the flip-flops 14 is connected to the inputs of additional monostable multivibrators 15 and 16. The monostable multivibrator 15 generates in response to the falling edge of the output pulse from the flip-flop 14 a pulse of a predetermined length which is applied to the input M of the shift register 4. The monostable multivibrator 16 is also set by the falling edge of the output signal from the flip-flop 14 and operates with a slightly longer time constant in comparison to the multivibrator 15. The output of the monostable multivibrator 16 is applied to an input of another NAND gate 17 whose other input is connected to the overflow output O of the shift register 4. The output of the NAND gate 17 is connected to the overflow output O of shift register 4. The output of the NAND gate 17 is connected to the unclock input U of the shift register.

Counter 3, shift register 4 as well as the frequency divider 6 are commercially available integrated circuits. For example, the counter 3 can be of the type 74 LS 161 of Texas Instruments and the shift register is for example a first in first out storing device of the type 74 LS 224 of the same firm. As divider 6 can be employed integrated circuit AM 95 13 of the firm Advanced Microdevices.

The operation of the time measuring device of this invention will be now explained with references to FIGS. 3 to 5. FIG. 3 illustrates a method in which the time intervals of successive events are measured relative to the first event. FIG. 3A shows the first event signals applied to the input A of the frequency divider in FIG. 1. These signals A which are delivered for example by the microcomputer 7 or by an external event, also apply to the reset input of the counter 3 and to the reset input of the frequency divider 6 so that the latter become cleared and a logic 1 signal is produced at the output of the divider 6 as illustrated in FIG. 3C. Due to this logic 1 signal the AND gate 2 opens and the clock signal P from the clock pulse generator 1 is fed into the counter 3. If a second event occurs at the input B of the control circuit 5, as indicated by the second pulse in FIG. 3B, the momentary count of the counter 3 is entered in the shift register 4. The same readout is initiated with the occurrence of all successive events on the input B and the successive momentary counts are illustrated in FIGS. 3B through 3G as pulse of different width. In the first storing stage of the shift register the measured time interval between the first or start event and the second event is stored (FIG. 3D), in the second storing stage is stored the time interval between the first or start event and the third event and in similar fashion FIG. 3F shows the time interval up to the fourth event and FIG. 3G shows the time interval between the start and the sixteenth event. In the case when sixteen bit shift register is used, it is possible to store in this manner sixteen consecutive time intervals. Thereafter the storing capacity is exhausted and the measured data for further events can no longer be stored. In this example the pulses at the input A following the first event signal (FIG. 3A) are insignificant because the gating time defining a measuring cycle as illustrated in FIG. 3C exceeds the time intervals between the signals A. The length of the gating time is determined from the dividing ratio of the divider 6 which when programmable divider is used, can be changed any time by the program of the microprocessor 7 so that the measuring cycle be adjusted to different measuring conditions. The readout pulse M for the storing device 4 is generated by the control logic circuit 5 as will be explained in greater detail below.

By subtracting the measured time intervals one from the other which operation can be undertaken for example by the microprocessor 7, the time differences between two arbitary events in the succession can be exactly determined. By virtue of this measuring method it is for the first time possible to measure digitally the duration of nonperiodic, irregular or one time signals.

For instance, it is possible to measure the contact bouncing time of relays so that the signal A is produced by the application of a voltage on the relay and the succession of following event signals B are derived for example from the zero crossings or from the peak values of voltages on switching contact of the relay. The frequency of the contact bouncing, the time of the bouncing, the switching time of the relay or of a switch due to the storing of different measured time periods can now be easily determined.

Inasmuch as the number of storing locations of the shift register is limited another operational method will be described in connection with FIG. 4. From FIG. 3 it will be recognized that during a measuring cycle corresponding to the gating time of FIG. 3C, it is not possible to measure all time intervals according to FIG. 3B. FIG. 4 illustrates a method according to which the last event pulses can be stored within a gating time period. The measuring cycle even in this case is initiated by a first event or start signal according to FIG. 4A. The measured events are indicated in FIG. 4B and the gating time period in FIG. 4C. The counts in counter 3 are represented by pulses of various length as indicated in FIGS. 4D through 4G. If the shift register is completely filled up by the measured events, then the first entered time interval data according to FIG. 4D is lost without being evaluated in the microprocessor. When the capacity of the storing device is exhausted, a signal O is generated and applied from the shift register 4 to the corresponding input in the control logic circuit 5. As a consequence, the control logic circuit 5 generates a signal U which causes that the oldest measured value is shifted out of the register when a new event signal B arrives to the control logic circuit 5. Due to the loss of the oldest time data a storing location is freed at the input of the shift register so that the new measured value can be entered. During the gating time period (FIG. 4C) the oldest values are thus replaced by the newly entered count values. After the expiration of the gating time period there are N−1 time intervals stored in the register whereby N denotes the number of storing locations.

After the expiration of the gating time the measuring data stored in the shift register are taken over by the computer. The number of stored time intervals which is dependent on the number of stages of the shift register, can be arbitrarily extended according to the desired maximum number of events to be measured. As mentioned before, the shift register operates as a first-in and first-out memory.

Since the device according to this invention is particularly suitable for the digital measurement of periodic or irregular signal sequences, it is necessary to provide measures which insure a reliable transfer of the counted data from the counter to the storing device. Such reliable transfer is possible only then when the count at a time point of the entry remains unchanged for a certain period of time during which the momentary value is read into the shift register. Inasmuch as the pulses B according to FIG. 3B or 4B can occur at arbitary time points, they must be synchronized with the clock signal of the clock generator 1. The resulting quantization error is due to the relatively high clock pulse frequency so small that it can be neglected. Moreover, in the method according to FIG. 4 care must be taken that in the case of a full shift register a storing location be cleared so that the new measured value datum might be read in.

The operation of the logic control circuit of FIG. 2 will be explained with reference to FIGS. 5A through 5G. A clock signal T according to FIG. 5A is applied to the clock input of the frequency divider 11. This clock signal T is divided by two and converted by the monostable multivibrator 12 into a succession of narrow pulses (FIG. 5B) whose rising edges coincide with the falling edges of pulses at the output of the divider 11. The succession of event signals B which are applied to the set input of the flip-flop 14, are illustrated in FIG. 5C. By means of these event signals B the flip-flop 14 is set and at its output occurs a logic one signal applied to the other input of the NAND gate 13. At the output of the latter therefore the narrow divided clock pulses according to FIG. 5B are negated and applied to the reset input of the flip-flop 14. By means of these reset pulses which are shown in FIG. 5E, the output of the flip-flop 14 is reset, as illustrated in FIG. 5D. The falling flanks of the output signal of flip-flop 14 sets the monostable multivibrators 15 and 16. The output signal from the monostable multivibrator 16 is shown in FIG. 5F. The falling flanks of the output signal from the monostable multivibrator 16 serves now as a readout command signal M for the shift register 4. The time duration of the multivibrator 16 is selected such that the transfer command pulse occurs within an interval between the clock pulses according to FIG. 5B. The monostable multivibrator 16 has a slightly longer time delay so that the output signal of multi-vibrator 16 falls a short time period after the falling flank of the output signal from the multivibrator 50. When the oldest data value in the shift register 4 is not to be replaced by a new one, then the signal at the output of multivibrator 16 is not needed.

When a signal O in the form of a logic 1 is generated indicating that the storing device is loaded to its full capacity then the NAND gate 17 becomes operative and the signal from the output of monostable multivibrator 16 is applied to the unclock input U of the shift register 4. As a consequence the oldest stored datum is discharged. The unclock signal U is shown in FIG. 5G. Since the monostable multivibrator 16 has a longer time constant than the multivibrator 15, an unclock pulse occurs only then when the last data word has been already entered into the register. Due to the unclock pulse, new storing location is cleared in the shift register and made ready for the entry of the next measured value.

It will be understood that each of the elements described above, or two or more together, may also find a useful application in other types of constructions differing from the types described above.

While the invention has been illustrated and described as embodied in a specific example of a time interval measuring device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for measuring time intervals between a plurality of events, comprising a clock pulse generator; a pulse counter having a clock input and an output; a gating member connected between said clock pulse generator and the clock pulse input of the counter; a multistage storing device having a data input connected to the output of said counter, a readout input, and an output; a first control circuit for setting an adjustable gating time for said gating member, said first control circuit having an input connectable to a source of a first or start event signal and an output connected to said gating member to start in response to a first event signal a measuring time cycle of a predetermined length; and a second control circuit having an input connectable to a source of subsequent event signals and an output connected to the readout input of said storing device; and said storing device retrieving in response to the output signals from said second control circuit corresponding to the occurrences of the subsequent event signals, momentary counts from said counter and storing said counts for further processing.

2. A device as defined in claim 1, wherein said multistage storing device is a shift register in which upon overflow of its storing capacity the oldest stored count from the counter is replaced by the newest count.

3. A device as defined in claim 1, wherein said second control circuit includes synchronizing means connected to said clock pulse generator for synchronizing the subsequent event signals with the clock pulses.

4. A device as defined in claim 3, wherein said first control circuit is coupled to the output of said clock pulse generator and includes a programmable frequency divider for adjusting the length of the gating time for said gating member.

5. A device as defined in claim 4, further comprising a programmable computing unit coupled to said programmable divider to adjust the length of the gating time for said gating member.

6. A device as defined in claim 5, wherein said computer is connected to the output of said shift register for retrieving and further processing count data stored in the latter.

* * * * *